US008757289B2

(12) United States Patent
Bauer et al.

(10) Patent No.: US 8,757,289 B2
(45) Date of Patent: Jun. 24, 2014

(54) UNDERWATER DRILLING ARRANGEMENT AND METHOD FOR MAKING A BORE IN A BED OF A WATER BODY

(75) Inventors: Thomas Bauer, Schrobenhausen (DE); Stefan Michael Finkenzeller, Reichertshofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 13/592,313

(22) Filed: Aug. 22, 2012

(65) Prior Publication Data

US 2013/0220699 A1 Aug. 29, 2013

(30) Foreign Application Priority Data

Aug. 23, 2011 (EP) ..... 11006879

(51) Int. Cl.
*E21B 7/124* (2006.01)
*E21B 4/18* (2006.01)

(52) U.S. Cl.
USPC ..... 175/6; 175/10; 175/65; 166/358

(58) Field of Classification Search
USPC ..... 175/5–7, 10, 65; 166/358, 71, 78.1; 405/228, 232, 249, 253
See application file for complete search history.

(56) References Cited

U.S. PATENT DOCUMENTS 2,023,966 A * 12/1935 Montee ..... 405/249
2,917,281 A * 12/1959 Kofahl ..... 175/7
3,519,071 A * 7/1970 Word, Jr. ..... 166/351
3,608,652 A * 9/1971 Medders et al. ..... 175/7
3,621,910 A * 11/1971 Sanford et al. ..... 166/335
3,672,447 A * 6/1972 Kofahl ..... 166/338
3,732,143 A * 5/1973 Joosse ..... 175/6
4,043,407 A * 8/1977 Wilkins ..... 175/50
4,255,068 A * 3/1981 Valantin ..... 405/195.1
4,352,595 A * 10/1982 Scodino ..... 405/158
4,510,985 A * 4/1985 Arnim et al. ..... 175/7

(Continued)

FOREIGN PATENT DOCUMENTS

DE 35 15 276 A1 10/1986
EP 2 322 724 A1 5/2011
GB 1 506 388 4/1978
GB 2 469 190 A 10/2010

OTHER PUBLICATIONS

European Search Report dated Mar. 9, 2012 from corresponding European Patent Application No. EP 11 00 6879.

*Primary Examiner* — Matthew Buck
(74) *Attorney, Agent, or Firm* — Studebaker & Brackett PC

(57) ABSTRACT

The invention relates to an underwater drilling arrangement and a method for making a bore in a bed of a lake, sea or river, having a service platform which can be lowered for positioning on the lake, sea or river bed, a guide tube which is mounted so that it can be rotated, axially moved as well as fixed on the service platform, a drill rod with drill head which is arranged in the guide tube and can be driven via a drill drive, and a guide tube drive which is arranged on the service platform for incorporation of the guide tube in the lake, sea or river bed. In order to reduce the friction which arises upon incorporation of the guide tube between the outer shell surface of the guide tube and the earth material of the lake, sea or river bed, the guide tube has a sliding support means.

11 Claims, 3 Drawing Sheets

(56) References Cited

U.S. PATENT DOCUMENTS

Figure 1:
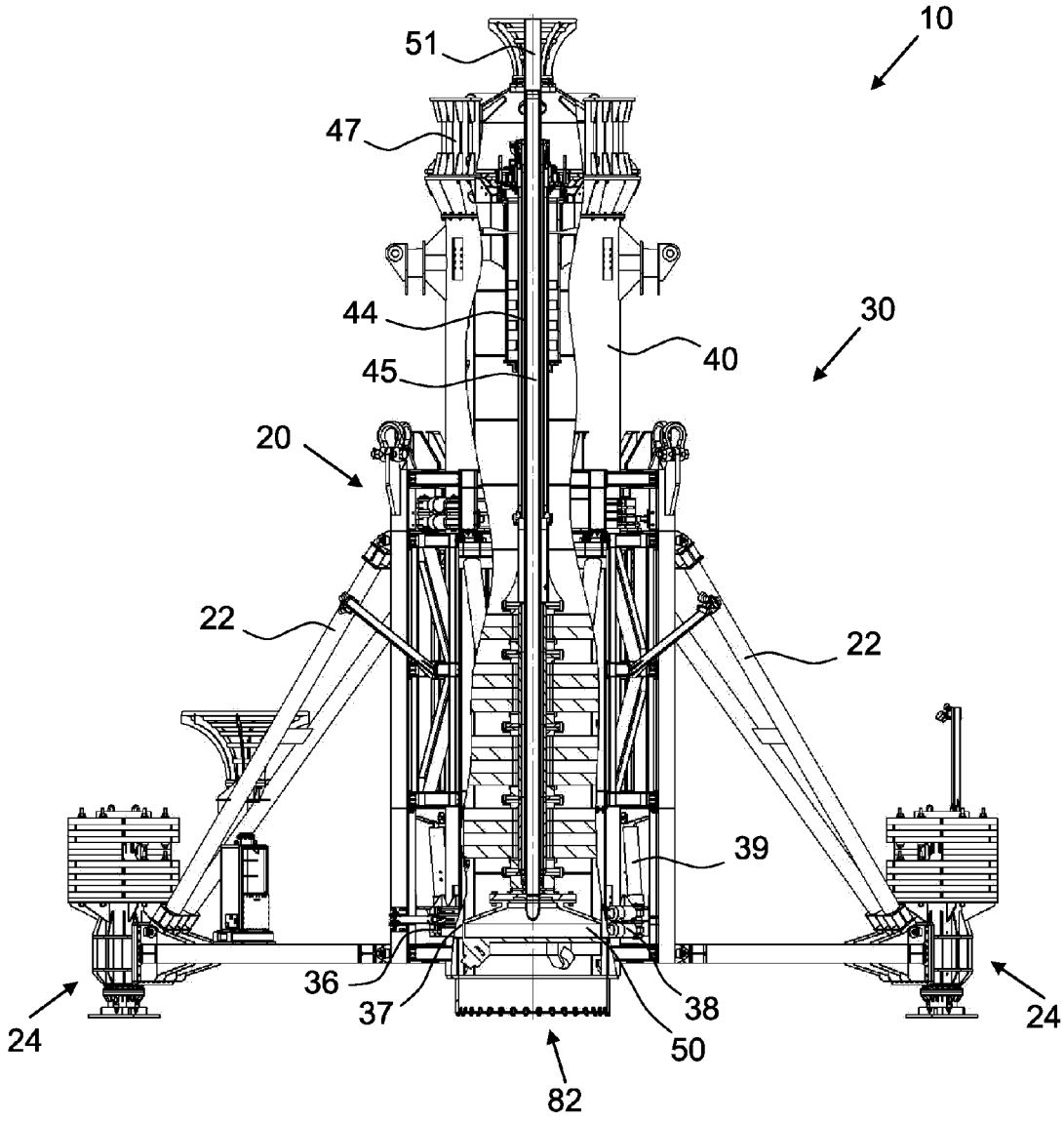

| | | | | | |
|---|---|---|---|---|---|
| 4,558,744 | A * | 12/1985 | Gibb | 166/335 |
| 4,742,876 | A * | 5/1988 | Barthelemy et al. | 175/7 |
| 4,744,698 | A * | 5/1988 | Dallimer et al. | 405/226 |
| 4,770,255 | A * | 9/1988 | Barthelemy et al. | 175/6 |
| 4,904,119 | A * | 2/1990 | Legendre et al. | 405/228 |
| 7,380,614 | B1 * | 6/2008 | Williamson et al. | 175/6 |
| 7,381,011 | B2 * | 6/2008 | Bogle | 405/248 |
| 7,703,534 | B2 * | 4/2010 | Sheshtawy | 166/358 |
| 2010/0119309 | A1 * | 5/2010 | Gibberd | 405/228 |
| 2011/0158752 | A1 * | 6/2011 | Hitchin | 405/232 |
| 2012/0177447 | A1 * | 7/2012 | Fraenkel et al. | 405/232 |

* cited by examiner

UNDERWATER DRILLING ARRANGEMENT AND METHOD FOR MAKING A BORE IN A BED OF A WATER BODY

The invention relates to an underwater drilling arrangement and a method for creating a bore in a bed of a water body.

Such a drilling arrangement can be used for example to create foundations for offshore wind plants or underwater turbines for tidal power plants.

GB 2 469 190 A discloses a drilling method, in which firstly a service platform is placed on the bed of a water body, like a lake, sea or river. A guide tube with a receiving funnel element is arranged on the service platform. A drilling tool is introduced into the guide tube and lowered onto the lake, sea or river bed to carry out the drilling.

A further method is known from EP 23 22 724 A1. In this underwater drilling arrangement a plurality of sleeve-like guide tubes are arranged on the service platform, in which already a tubular foundation element is arranged. The tubular foundation element is screwed via a drill drive put in position which is released from the foundation element after the bore has been created.

In these known drilling arrangements the guide tubes are arranged on the service platform. A guide length is hereby limited.

It is the object of the invention to indicate an underwater drilling arrangement and a method for making a bore in a bed of a water body, wherein the bore can be created particularly accurately in terms of position as well as securely.

The object is achieved on the one hand through an underwater drilling arrangement having the features of claim 1. On the other hand the object is achieved through a method having the features of claim 9. Preferred embodiments of the invention are indicated in the respectively dependent claims.

The underwater drilling arrangement according to the invention comprises a service platform which can be lowered for positioning on the bed of a water body, a guide tube which is mounted on the service platform so that it can be rotated and axially moved as well as adjusted, a drill rod with a drill head which is arranged in the guide tube and can be driven via a drill drive and a guide tube drive which is arranged on the service platform for introducing the guide tube into the bed of a water body, like a lake, sea or river, wherein the guide tube comprises a sliding support means for reducing the friction arising during incorporation of the guide tube between the outer shell surface of the guide tube and the earth material of the lake, sea or river bed.

A core idea of the invention lies in that the guide tube is incorporated at least partially into the bed of a lake, sea or river. For this purpose its own guide tube drive is provided, with which the guide tube can be rotated and/or pressed into the lake, sea or river bed. The incorporation can also take place through vertical vibrations or impact movements. A subsequent guiding of the guide tube into the lake, sea or river bed is thus possible so that the drilling tool is guided longer and better. The sliding support means thereby has the function of facilitating exact incorporation of the guide tube. In particular during rotating-in of the guide tube the risk is thus avoided that, due to the friction between the outer shell surface of the guide tube and the lake, sea or river bed, the service platform is rotated relative to the guide tube. The force which must be expended for torque support on the erection feet of the service platform is thus reduced. In addition the anchoring of the service platform with the water bed is improved. Preferably, the drill drive is arranged inside the drill tube and can be axially displaced and fixed.

According to an embodiment of the invention it is provided that the sliding support means comprises at least one feed means for feeding a friction reducing fluid in a region of the outer shell surface of the guide tube. The feed means has the function of conveying the friction reducing fluid used directly into the required region between the outer shell surface of the guide tube and the earth material of the lake, sea or river bed. The feed means can for example be configured as a tubular line system which extends along the guide tube. In order to reduce friction, suitable fluids can be used such as for example oil-containing liquids, gases or also non-Newtonian liquids such as for example bentonite.

Furthermore it is preferred that the feed means comprises at least one supply line which is arranged within the guide tube and comprises at least one outlet opening in the wall of the guide tube. In this arrangement the supply line is protected by the wall of the guide tube. The supply line can thereby extend in the inner space of the guide tube or also be integrated into grooves of the guide tube. The at least one supply line is connected to one or more outlet openings, via which the fluid can be discharged radially into the region of the outer shell surface. The outlet openings can extend over the whole region of the guide tube, but the outlet openings are preferably substantially arranged in the lower region of the guide tube.

The outlet openings can also be formed as nozzles or similar in order to expel the friction reducing fluid under pressure. The outlet openings do not have to be directly connected to the supply line but can instead also be connected to the supply line via passage channels which extend radially through the guide tube towards externally.

It is preferable that a fluid container is provided which is connected to the at least one supply line. The fluid container can be provided for example on the service platform or in the upper region of the guide tube or be positioned remote from the service platform on a supply vessel. The fluid container could also include a plurality of separate chambers which are filled with different fluids which are introduced according to requirements into the supply line.

According to a preferred embodiment of the invention at least one pump is provided, with which fluid can be conveyed from the fluid container to the outlet opening. Through the at least one pump the required pressure can be produced, with which the fluid is expelled form the outlet openings. Displacement pumps or flow pumps can be used as pumps.

According to the invention it is advantageous that the guide tube has a cutting means in the region of its lower edge. The cutting means has the function of facilitating the incorporation of the guide tube into the water bed. The cutting means is preferably configured as a ring gear with a plurality of cutting teeth which cut into the ground with a left or right rotation of the guide tube.

It is provided according to the invention that at least one outlet opening for fluid is arranged in the close vicinity of the cutting means. The fluid is thereby discharged directly at the lower edge of the guide tube, whereby the friction reducing effect is optimally exploited. The outlet openings can be arranged laterally on the guide tube and point radially outwards or also be arranged at the lower end above or also between the cutting teeth.

According to a further embodiment of the invention the sliding support means comprises an anti-friction coating which is arranged on an outer side of the guide tube. The outer side could be provided for example with a Teflon coating, whereby the friction produced between the ground material and the rotating outer side of the guide tube is reduced. Other coatings such as friction reducing metal alloys or carbon fibre reinforced plastics can also be used. A passive sliding support is thus achieved which unleashes its friction reducing effect upon the guide tube without further means being necessary for this.

This passive sliding support can be combined in particular with the addition of friction reducing fluid in order to achieve a high friction reducing effect.

The object mentioned at the start is further achieved through a method for making a bore in a bed of a water body, in particular with an underwater drilling arrangement, in which a service platform with a guide tube is lowered and positioned on the bed of the water body, wherein a drill rod with a drill head is arranged in the guide tube and axially guided, wherein the drill rod is driven in rotation by means of a drill drive, the guide tube is incorporated into the bed of the water body and by means of a sliding support arranged on the guide tube the friction arising when the guide tube is introduced between the outer shell surface of the guide tube and the earth material of the bed of the water body is reduced. The guide tube is preferably rotated and/or axially pressed into the water bed by means of the guide tube drive.

The incorporation of the guide tube can be supported by vibrations triggered by the guide tube drive parallel to the longitudinal extension of the guide tube. The rotation direction of the guide tube is preferably adapted to the mode of functioning of the cutting means and can be rotated both clockwise or anti-clockwise via the guide drive.

According to the invention the sliding support means comprises a feed means, with which a fluid is incorporated in a region between the outer shell surface of the guide tube and a surrounding earth material in order to reduce the friction. Bentonite is preferably used as the fluid, whereby this hardens after the drilling process and can thus be used as a supporting liquid of the bore created, whereby this facilitates the subsequent pile foundation.

Figure 2:
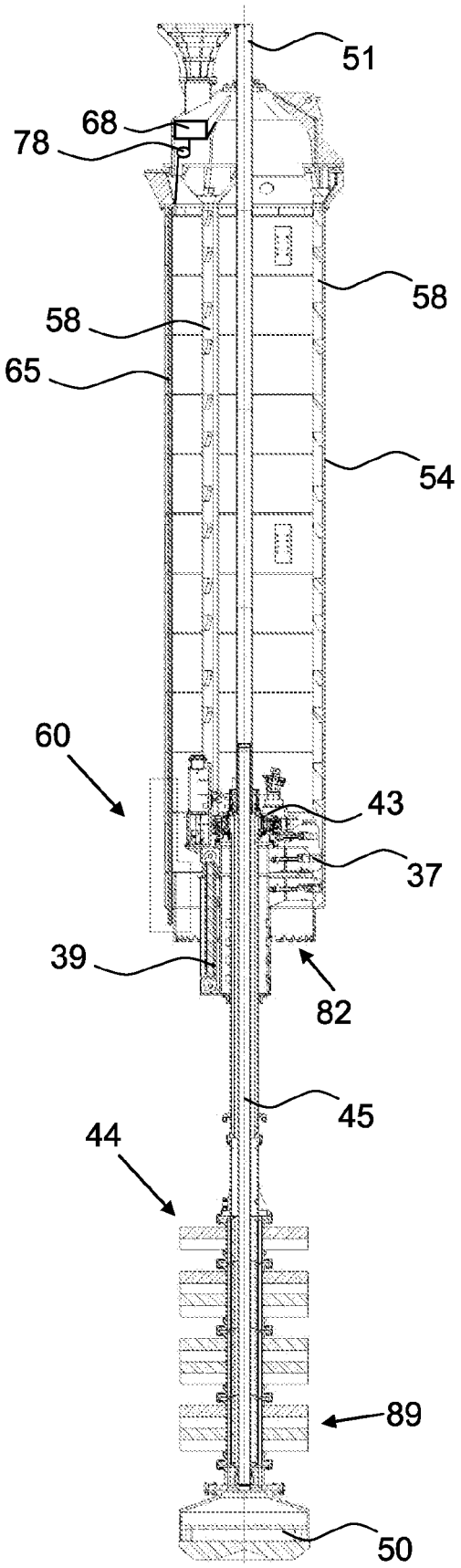
Figure 3:
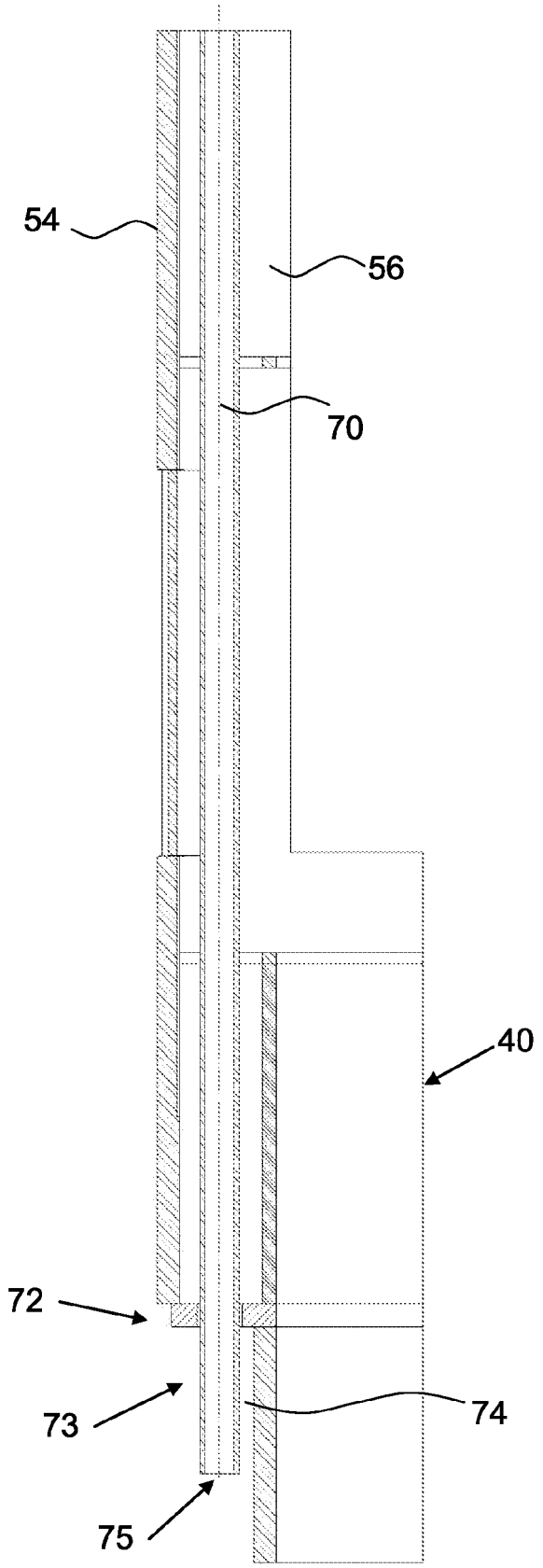

The invention is explained in further detail below using preferred exemplary embodiments which are schematically shown in the attached drawings, in which:

FIG. 1 shows a side view of an underwater drilling arrangement according to the invention;

FIG. 2 a detailed view of the guide tube of the sliding support;

FIG. 3 an enlarged view of the inventive sliding support.

A principal structure of an underwater drilling arrangement according to the invention for making a bore in a bed of a water body is shown in FIG. 1. The service platform 30 comprises a base body 20, on which a plurality of support struts 22 are fixed, on which supporting feet 24 are arranged for positioning on the bed of the water body, like a lake, sea or river. In order to create a bore the service platform 30 is lowered onto the lake, sea or river bed and subsequently placed with the support feet 24 on the lake, sea or river bed. The supporting feet 24 or erection feet are designed to be adjustable in order to compensate unevenness on the lake, sea or river bed, whereby the service platform 30 can be brought into the desired drilling position.

In the middle of the base body 20 there is a recess 32, in which a guide tube is incorporated. The guide tube 40 is mounted to be rotational and axially movable relative to the base body 20. In order to rotate the guide tube 40 relative to the service platform 30, a guide drive 36 is arranged in the lower region of the base body. The guide drive 36 comprises a hydraulically clampable collet 37 which can be rotated by means of a horizontal cylinder 38. In addition a vertical force can also be exerted on the guide tube 40 with a vertical cylinder 39.

In the upper region of the guide tube a feed funnel 47 is arranged which facilitates the incorporation and subsequent incorporation of a drilling tool 44 which is lowered via cable winches from a supply vessel (not shown). The drilling tool 44 comprises a cylindrical drill rod 45, on the lower end of which a drill head 50 is arranged. The supply of the drilling tool 44 with energy, flushing liquid or also hardenable mass such as for example concrete takes place via a supply channel 51, with which the drilling tool 44 is connected to the supply vessel. The service platform 30 is also connected via cable assemblies (not shown) to the supply vessel and is thereby supplied with energy.

FIG. 2 shows a detailed illustration of the guide tube 40 with introduced drilling tool 44. At the lower end of the drilling tool 44 a drill head 50 is arranged for handling stone or rock material. Above the drill head 50 there are load plates 89 fixed to the drill rod 45 and which, through their weights, increase the load on the drill heads 50.

The drill rod is axially moved within the guide tube 40 on guide rails 58 provided for this purpose arranged on the inner shell surface of the guide tube 40.

As soon as the service platform 30 has been lowered to the desired position on the lake, sea or river bed and brought via the supporting feet 24 into a stable position, the guide tube 40 is then incorporated into the lake, sea or river bed.

The drill drive 43 is mounted and guided in an axially displaceable and fixable manner inside the guide tube 40. The drill drive 43 comprises a hydraulic drive which transmits torque to the drill rod 45. At first, the guide tube 40 is drilled into the bed of the water body up to a first depth, while the drill drive 43 with the drill rod 50 is fixed in its upper position in the guide tube 40, as shown in FIG. 1. Subsequently, the drill head 50 is drilled to the final depth of the bore hole and the drill drive 43 moves downwards, while the guide tube 40 is fixed. As shown in FIG. 2, the drill rod 45 with the drill head 50 extends downwards beyond the drill tube 40.

The guide tube 40 is set in rotation by means of the guide drive 36 relative to the base body 20 of the service platform 30, wherein the cutting means 82 arranged on the lower edge of the guide tube 40 rotates into the ground. The friction which arises between the outer shell surface of the section of the guide tube already in the ground and ground material is reduced by a sliding support means 60 through the supply of bentonite.

The region of the sliding support means 60 in FIG. 2 is shown once again enlarged in FIG. 3. The diameter of the guide tube 40 is reduced in the lower guide tube section 72, whereby a substantially rectangular indentation 73 is produced. In the region of the indentation 73 the guide tube 40 comprises a downwardly orientated wall opening 74, on which an outlet opening 75 of a feed means 65 is arranged. The outlet opening 75 is arranged in the close vicinity above the cutting means 82. The outlet opening 75 is connected to the feed means 65, whereby the bentonite is conveyed via a supply line 70 from a fluid container 68 by means of a pump 78. The supply line 70 is arranged on the inner side of the wall 65 of the guide tube 40.

The bentonite thereby serves as a sliding means in order to reduce the friction in the region of the outer shell surface 54. Due to the reduced friction force the force which acts, for torque support of the guide tube 40, on the supporting feet 24 arranged on the base body 20 is reduced. The guide tube 40 can thereby be incorporated deeper into the lake, sea or river bed without the whole service platform co-rotating due to the torque support.

Due to the guide tube 40 incorporated deeply, a stable anchoring of the service platform 30 with the lake, sea or river bed can be achieved, whereby position-accurate drilling is facilitated.

The invention claimed is:

1. Underwater drilling arrangement for creating a bore in a bed of a water body, having a service platform which can be lowered for positioning on the bed of the water body, a guide tube which is mounted so that it can be rotated and axially moved as well as fixed on the service platform, a drilling tool including a drill rod with drill head arranged at the lower end of the drill rod, said drilling tool is arranged in the guide tube and said drill rod can be driven via a drill drive and a guide tube drive which is arranged on the service platform, said guide tube drive is adapted to rotationally drive the guide tube for driving the guide tube into the bed of the water body, wherein the guide tube comprises a sliding supporter for reducing the friction arising during driving the guide tube into the bed of the water body between an outer shell surface of the guide tube and the earth material of the bed of the water body.

2. Underwater drilling arrangement according to claim 1, wherein the sliding supporter comprises at least one feeder for feeding a friction reducing fluid into a region of the outer shell surface of the guide tube.

3. Underwater drilling arrangement according to claim 2, wherein the feeder comprises at least one supply line which is arranged within the guide tube and comprises at least one outlet opening in the wall of the guide tube.

4. Underwater drilling arrangement according to claim 3, wherein a fluid container is provided which is connected to the at least one supply line.

5. Underwater drilling arrangement according to claim 4, wherein at least one pump is provided, with which fluid can be conveyed from the fluid container to the outlet opening.

6. Underwater drilling arrangement according to claim 1, wherein the guide tube comprises a cutting means in the region of its lower edge.

7. Underwater drilling arrangement according to claim 6, wherein at least one outlet opening for fluid is arranged in the close vicinity of the cutting means.

8. Underwater drilling arrangement according to claim 1, wherein the sliding supporter comprises an anti-friction coating which is arranged on an outer side of the guide tube.

9. Method for making a bore in a bed of a water body, in particular with an underwater drilling arrangement according to claim 1, in which a service platform is lowered with a guide tube and positioned on the bed of the water body, wherein a drill rod with a drill head is arranged and axially guided in the guide tube, wherein the drill rod is rotatably driven by means of a drill drive, the guide tube is driven to rotate to rotationally driven into the bed of the water body, and by means of a sliding supporter arranged on the guide tube the friction arising, during driving the guide tube into the bed of the water body, between an outer shell surface of the guide tube and the earth material of the bed of the water body is reduced.

10. Method for making a bore according to claim 9, wherein the guide tube is rotated and/or axially pressed by means of the guide drive into the bed of the water body.

11. Method for making a bore according to claim 9, wherein the sliding supporter comprises a feed means, with which a fluid is incorporated into a region between the outer shell surface of the guide tube and a surrounding earth material in order to reduce the friction.

* * * * *